US009002232B2

(12) United States Patent
Tsukahara et al.

(10) Patent No.: US 9,002,232 B2
(45) Date of Patent: Apr. 7, 2015

(54) IMAGE FORMING APPARATUS

(71) Applicant: KYOCERA Document Solutions Inc., Osaka (JP)

(72) Inventors: Shigeki Tsukahara, Osaka (JP); Takahiko Murata, Osaka (JP); Ai Takagami, Osaka (JP); Koichi Hayashi, Osaka (JP); Nobuyuki Hayashi, Osaka (JP); Yosuke Saito, Osaka (JP); Maki Ike, Osaka (JP); Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/229,733

(22) Filed: Mar. 28, 2014

(65) Prior Publication Data

US 2014/0308053 A1 Oct. 16, 2014

(30) Foreign Application Priority Data

Apr. 10, 2013 (JP) ..... 2013-081920
Apr. 10, 2013 (JP) ..... 2013-081921
Nov. 14, 2013 (JP) ..... 2013-235751

(51) Int. Cl.
*G03G 15/02* (2006.01)
*G03G 15/00* (2006.01)
*G03G 21/00* (2006.01)

(52) U.S. Cl.
CPC ..... *G03G 15/0266* (2013.01); *G03G 15/751* (2013.01); *G03G 21/0094* (2013.01)

(58) Field of Classification Search
CPC ..... G03G 15/0266; G03G 15/751
USPC ..... 399/26, 96, 116, 159
See application file for complete search history.

(56) References Cited

U.S. PATENT DOCUMENTS

2006/0088325 A1* 4/2006 Suzuki ..... 399/44
2006/0233565 A1* 10/2006 Tamaoki ..... 399/96
2007/0201895 A1* 8/2007 Nakano ..... 399/96
2010/0232825 A1* 9/2010 Kakitani ..... 399/90

FOREIGN PATENT DOCUMENTS

JP 2007-94354 A 4/2007
JP 2012-141541 A 7/2012

* cited by examiner

*Primary Examiner* — Francis Gray
(74) *Attorney, Agent, or Firm* — Stein IP, LLC

(57) ABSTRACT

An image forming apparatus includes an image bearing member, a conductive member, a bias application device, and a control portion. The image bearing member has a photosensitive layer formed on an outer peripheral surface thereof. The conductive member is disposed so as to make contact with an inner peripheral surface of the image bearing member and has a dielectric property. The bias application device applies a bias including an alternating current bias to the conductive member. The control portion controls the bias application device. The image forming apparatus is capable of executing a heating-up mode in which an alternating current bias having a peak-to-peak value twice or more as large as a discharge start voltage between the conductive member and the image bearing member is applied to the conductive member to cause the surface of the image bearing member to be heated up.

17 Claims, 10 Drawing Sheets

IMAGE FORMING APPARATUS

INCORPORATION BY REFERENCE

This application is based on and claims the benefit of priority from Japanese Patent Applications No. 2013-81920 filed on Apr. 10, 2013, No. 2013-81921 filed on Apr. 10, 2013, and No. 2013-235751 filed on Nov. 4, 2013 the contents of which are hereby incorporated by reference.

BACKGROUND OF THE INVENTION

The present disclosure relates to an image forming apparatus using a photosensitive drum, and relates particularly to a method for removing moisture on a surface of the photosensitive drum.

In an image forming apparatus using an electrophotographic method, such as a copy machine, a printer, or a facsimile, a developing agent in powder form (hereinafter, referred to as toner) is mainly used, and, typically, a process is performed in which an electrostatic latent image formed on an image bearing member such as a photosensitive drum is visualized by using the toner in a developing device, and a toner image thus formed is transferred onto a recording medium and then subjected to fixing processing. A photosensitive drum is formed of a cylindrical base member and a photosensitive layer of ten to several tens of μm in thickness formed on a surface of the cylindrical base member. In terms of a main material constituting the photosensitive layer, photosensitive drums can be classified into an organic photosensitive member, a selenium arsenic photosensitive member, an amorphous silicon (hereinafter, abbreviated as a-Si) photosensitive member, and so on.

The organic photosensitive member, though being relatively low-cost, is susceptible to wear and thus requires frequent replacement thereof. Furthermore, the selenium arsenic photosensitive member, though having a long life compared with the organic photosensitive member, is, disadvantageously, a toxic substance and thus is difficult to handle. On the other hand, the a-Si photosensitive member, though being costly compared with the organic photosensitive member, is a harmless substance and thus is easy to handle. In addition, the a-Si photosensitive member has a high hardness and thus has excellent durability (which is five or more times greater than that of the organic photosensitive member), and characteristics thereof as a photosensitive member are hardly degraded even after long-term use, so that a high image quality can be maintained. The a-Si photosensitive member thus makes an excellent image bearing member whose running cost is low and that achieves a high level of environmental safety.

As is known, in an image forming apparatus using a photosensitive drum of any of the above-described types, due to characteristics thereof, depending on conditions of use, so-called image deletion is likely to occur, i.e. a faded image or an image smeared at a periphery thereof is likely to be formed. A factor responsible for the occurrence of image deletion is as follows. That is, when a surface of the photosensitive drum is charged by using a charging device, ozone is generated due to electrical discharge by the charging device. By the ozone thus generated, components contained in the air are decomposed to generate ion products such as $NO_x$ and $SO_x$. Being soluble in water, these ion products adhere to the photosensitive drum and penetrate into an about 0.1 μm-thick roughness structure of the surface of the photosensitive drum. This makes it impossible for the ion products to be removed by using a cleaning system used in a general-purpose apparatus, and they take in moisture in the atmospheric air, which leads to a decrease in resistance of the surface of the photosensitive drum. Because of this, a lateral flow of potential occurs at an edge portion of an electrostatic latent image formed on the surface of the photosensitive drum, which may result in the occurrence of image deletion. This phenomenon is pronounced particularly in a case of the a-Si photosensitive member, which hardly suffers from surface wear caused by a blade or the like and whose surface has a molecular structure likely to absorb moisture.

Various methods for preventing the occurrence of such image deletion have conventionally been proposed. For example, a method is known in which a heat generating member (heater) is provided inside a photosensitive drum or inside a rubbing member being in contact with the photosensitive drum, and controlled, based on a temperature and a humidity detected by a temperature and humidity sensor in an apparatus, to perform heating to evaporate moisture adhering to a surface of the photosensitive drum, so that the occurrence of image deletion is prevented.

The method in which the heater is disposed inside the photosensitive drum, however, requires that a slider electrode be used to connect the heater to a power source. Due to the presence of this sliding portion that connects the heater to the power source, as a total length of time of rotation of the photosensitive drum increases, a contact fault occurs at the sliding portion, which has been disadvantageous. Furthermore, in these days when there is a growing need for measures directed toward energy saving and environmental protection, it is strongly demanded that power consumption at the time of standby and at the time of normal printing be reduced. Particularly an image forming apparatus of a type having a plurality of drum units, such as a tandem-type full-color image forming apparatus, is large in power consumption, and hence it is not desirable to incorporate a heater therein. Other methods include a method in which heat around a cassette heater or a fixing device is transmitted to a vicinity of a photosensitive drum. This method, however, is not efficient in that a developing device and so on in the vicinity also are undesirably heated.

As a solution to the above, an image forming apparatus is known that sets a weak charging period in which a charging voltage formed only of a direct current voltage or a charging voltage obtained by superimposing an alternating current voltage lower than that used at the time of image formation on a direct current voltage is applied, to a prescribed period before a start or after completion of a regular charging period or between a plurality of regular charging periods, thereby suppressing the generation of by-products of electrical discharge caused by application of a charging bias at a time other than the time of image formation.

Furthermore, an image forming apparatus is known that is capable of executing a moisture removing mode of performing, in order, a first moisture removing step in which, by using a cleaning blade, moisture is removed from a surface of a photosensitive drum, a second moisture removing step in which toner on a developing roller is conveyed toward the photosensitive drum and used to absorb moisture on the surface of the photosensitive drum, and the moisture is removed together with the toner, and a third moisture removing step in which moisture on a charging roller and on the surface of the photosensitive drum is removed by application of a voltage to the charging roller.

SUMMARY OF THE INVENTION

An image forming apparatus according to a first aspect of the present disclosure includes an image bearing member, a conductive member, a bias applicator, and a controller, and performs image formation on a surface of the image bearing member while making the image bearing member rotate. The image bearing member has a photosensitive layer formed on an outer peripheral surface thereof. The conductive member is disposed so as to make contact with an inner peripheral surface of the image bearing member and has a dielectric property. The bias applicator applies a bias including an alternating current bias to the conductive member. The controller controls the bias applicator. The image forming apparatus is capable of executing a heating-up mode in which an alternating current bias having a peak-to-peak value twice or more as large as a discharge start voltage between the conductive member and the image bearing member is applied to the conductive member to cause the surface of the image bearing member to be heated up.

Still other objects of the present disclosure and specific advantages provided by the present disclosure will be made further apparent from the following descriptions of embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
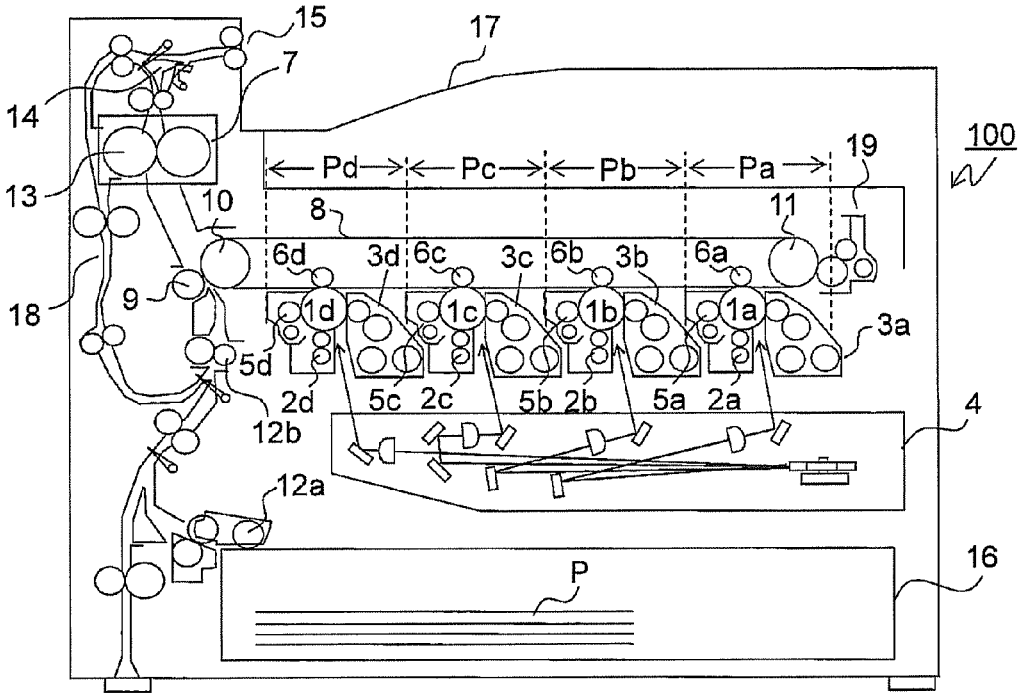
FIG. 1 is a schematic sectional view showing an overall configuration of a color printer 100 according to a first embodiment of the present disclosure.

With reference to the appended drawings, the following describes an embodiment of the present disclosure. FIG. 1 is a schematic view showing a configuration of a color printer 100 according to a first embodiment of the present disclosure. In a main body of the color printer 100, four image forming portions Pa, Pb, Pc, and Pd are arranged in order from an upstream side in a conveying direction (a right side in FIG. 1). The image forming portions Pa to Pd are provided so as to correspond to images of four different colors (cyan, magenta, yellow, and black) and form, in order, images of cyan, magenta, yellow, and black, respectively, through steps of charging, exposure, developing, and transfer.

In the image forming portions Pa to Pd, photosensitive drums 1*a*, 1*b*, 1*c*, and 1*d* to bear thereon visualized images (toner images) of the respective colors are arranged, respectively, and, herein, as each of the photosensitive drums 1*a*, 1*b*, 1*c*, and 1*d*, an a-Si photosensitive member formed of a drum base member made of aluminum and an a-Si photosensitive layer formed on an outer peripheral surface of the drum base member is used. Moreover, an intermediate transfer belt 8 that is driven by a driver (not shown) to rotate in a clockwise direction in FIG. 1 is provided adjacently to the image forming portions Pa to Pd. The toner images formed on the photosensitive drums 1*a* to 1*d*, respectively, are primarily transferred in order onto the intermediate transfer belt 8 moving while being in contact with the photosensitive drums 1*a* to 1*d*, so as to be superimposed on each other. Thereafter, by an action of a secondary transfer roller 9, the toner images are secondarily transferred onto a sheet of transfer paper P as one example of a recording medium and fixed, at a fixing portion 7, onto the sheet of transfer paper P, which then is ejected from the apparatus main body. An image forming process with respect to each of the photosensitive drums 1*a* to 1*d* is executed while the photosensitive drums 1*a* to 1*d* are made to rotate in, for example, a counterclockwise direction in FIG. 1.

The transfer paper P onto which toner images are to be transferred is housed in a paper sheet cassette 16 at a lower portion in the apparatus, and is conveyed to the secondary transfer roller 9 via a paper feeding roller 12*a* and a registration roller pair 12*b*. As the intermediate transfer belt 8, a non-seamed (seamless) belt made of a dielectric resin sheet is mainly used. Furthermore, on an upstream side in a rotation direction of the intermediate transfer belt 8 with respect to the photosensitive drum 1*a*, a belt cleaning unit 19 is disposed that faces a drive roller 11 with the intermediate transfer belt 8 interposed therebetween.

The description is directed next to the image forming portions Pa to Pd. Around and below the photosensitive drums 1*a* to 1*d*, which are rotatably arranged, there are provided charging devices 2*a*, 2*b*, 2*c*, and 2*d* that charge the photosensitive drums 1*a* to 1*d*, respectively, an exposure unit 4 that exposes image information onto the photosensitive drums 1*a* to 1*d*, developing devices 3*a*, 3*b*, 3*c*, and 3*d* that form toner images on the photosensitive drums 1*a* to 1*d*, respectively, and cleaning devices 5*a* to 5*d* that remove a developing agent (toner) remaining on the photosensitive drums 1*a* to 1*d*, respectively.

Figure 2:
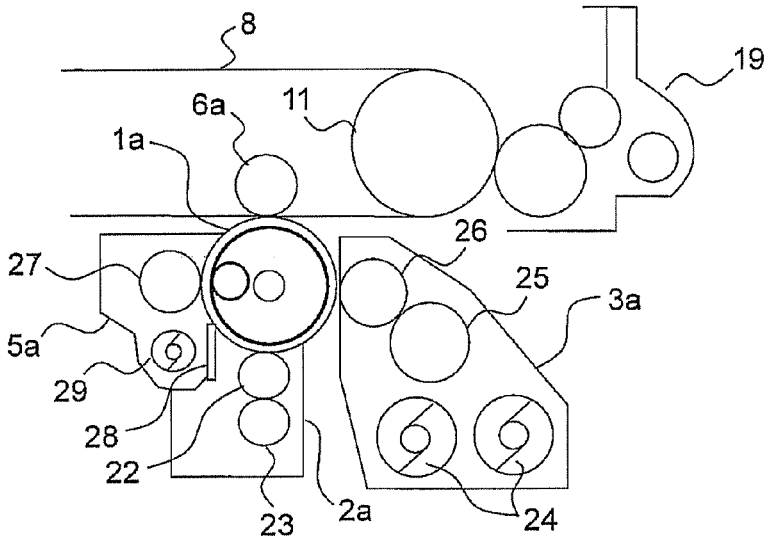
FIG. 2 is a partially enlarged view of a vicinity of an image forming portion Pa shown in FIG. 1.
Figure 3:
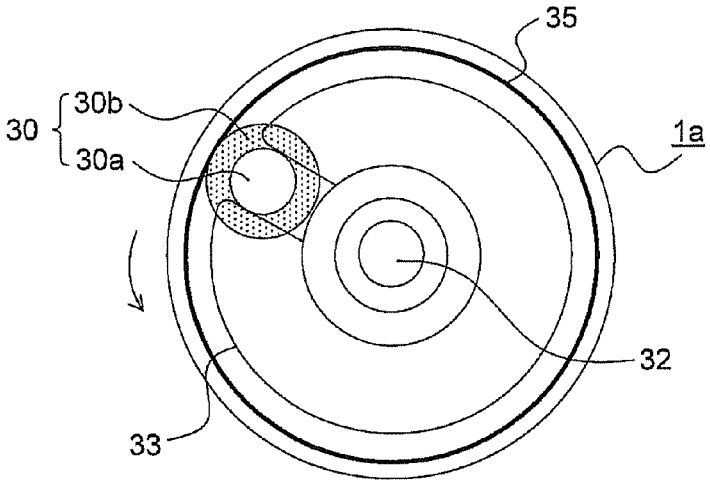
FIG. 3 is a sectional side view of a vicinity of an end portion of a photosensitive drum 1*a* shown in FIG. 2, taken in a direction perpendicular to an axial direction of the photosensitive drum 1*a*.
Figure 4:
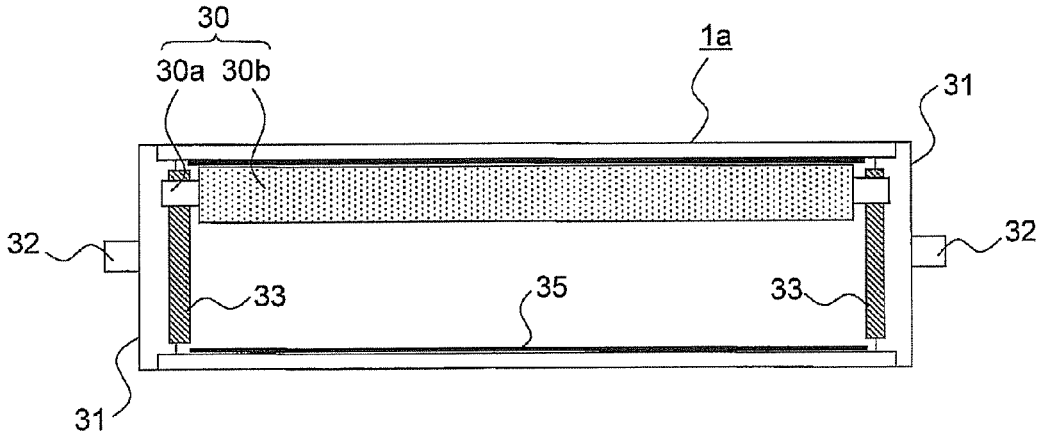
FIG. 4 is a sectional side view of the photosensitive drum 1*a* taken along the axial direction.

With reference to FIGS. 2 to 4, the following describes in detail the image forming portion Pa, while omitting descriptions of the image forming portions Pb to Pd whose configurations are basically similar to that of the image forming portion Pa. As shown in FIG. 2, around the photosensitive drum 1*a*, the charging device 2*a*, the developing device 3*a*, and the cleaning device 5*a* are arranged along a drum rotation direction (the counterclockwise direction in FIG. 1), and a primary transfer roller 6*a* is disposed with the intermediate transfer belt 8 interposed between the primary transfer roller 6*a* and the photosensitive drum 1*a*.

The charging device 2*a* has a charging roller 22 that makes contact with the photosensitive drum 1*a* and applies a charging bias to a drum surface thereof and a charging cleaning roller 23 for cleaning the charging roller 22. The charging roller 22 is configured by forming a roller body made of a conductive material such as an epichlorohydrin rubber on an outer peripheral surface of a metallic shaft.

The developing device 3*a* has two stirring and conveying screws 24, a magnetic roller 25, and a developing roller 26, and applies a developing bias having the same polarity (positive polarity) as that of toner to the developing roller 26 to cause the toner to fly onto the drum surface.

The cleaning device 5*a* has a cleaning roller 27, a cleaning blade 28, and a collection screw 29. The cleaning roller 27 is provided in press-contact with the photosensitive drum 1*a* under a prescribed pressure and is driven by an unshown driver to rotate in the same direction, at a contact surface with the photosensitive drum 1*a*, as that in which the photosensitive drum 1*a* rotates, and a circumferential velocity of its rotation is controlled to be faster (herein, 1.2 times faster) than that of the rotation of the photosensitive drum 1*a*. The cleaning roller 27 is structured by, for example, forming, as a roller body, a foam body layer made of an EPDM rubber and having an Asker C hardness of 55° around a metal shaft. As a material of the roller body, without any limitation to an EPDM rubber, any other type of rubber or a foamed rubber body of any other type of rubber may be used, and favorably used is such a material having an Asker C hardness in a range of 10° to 90°.

On the surface of the photosensitive drum 1*a*, on a downstream side in the rotation direction with respect to the contact surface with the cleaning roller 27, the cleaning blade 28 is fastened in a state of being in contact with the photosensitive drum 1*a*. The cleaning blade 28 is formed of, for example, a blade made of a polyurethane rubber and having a JIS hardness of 78°, and is mounted such that, at a contact point with the photosensitive drum 1*a*, it forms a prescribed angle with a photosensitive member tangential direction. A material, a hardness, dimensions, a biting amount into the photosensitive drum 1*a*, a press-contact force against the photosensitive drum 1*a*, and so on of the cleaning blade 28 are set as appropriate in accordance with specifications of the photosensitive drum 1*a*.

Residual toner removed from the surface of the photosensitive drum 1*a* by the cleaning roller 27 and the cleaning blade 28 is drained, as the collection screw 29 rotates, to the outside of the cleaning device 5*a* and conveyed to a toner collection container (not shown) to be stored therein. As toner used in this disclosure, there is used a type having a particle surface in which, as an abrasive, silica, titanium oxide, strontium titanate, alumina or the like is embedded and held so as to partly protrude on the surface, or a type having a surface to which an abrasive electrostatically adheres.

Inside the photosensitive drum 1*a*, a conductive roller 30 is disposed. As shown in FIG. 3, the conductive roller 30 is configured by forming a roller body 30*b* made of a conductive material such as an EPDM rubber on an outer peripheral surface of a metallic shaft 30*a*. The shaft 30*a* is fastened to a flange 31 mounted to each of both end portions of the photosensitive drum 1*a* and rotatably supported by a guide member 33 that rotates together with a rotary shaft 32 of the photosensitive drum 1*a*, and the roller body 30*b* is in contact with an insulation layer 35 formed on an inner peripheral surface of the photosensitive drum 1*a*.

The insulation layer 35 is, for example, an alumite layer formed by subjecting an inner peripheral surface of a drum base member to alumite treatment. The insulation layer 35 can be formed also by, instead of forming an alumite layer, applying a coating of an insulative resin to the inner peripheral surface of the photosensitive drum 1*a* or attaching an insulative resin sheet thereto. As the insulative resin, a fluorine-based resin such as PTFE (polytetrafluoroethylene) or PFA (tetrafluoroethylene-perfluoroalkyl vinyl ether copolymer), a silicone resin, or the like is used. The insulation layer 35 preferably has a resistance value of not less than $10^{10}\Omega$.

When the photosensitive drum 1*a* rotates in the counterclockwise direction, the guide member 33 fastened to the flange 31 also rotates in the counterclockwise direction. With this configuration, the conductive roller 30 revolves, while rotating on its axis in the clockwise direction, around the rotary shaft 32 in the counterclockwise direction along the inner peripheral surface of the photosensitive drum-1*a*. A heating-up bias power source 45 (see FIG. 5) is connected to the conductive roller 30 so that a bias including an alternating current bias can be applied to the conductive roller 30.

Upon a user's input of a command to start image formation, first, the surfaces of the photosensitive drums 1*a* to 1*d* are uniformly charged by the charging devices 2*a* to 2*d*, respectively, and then are irradiated with light by the exposure unit 4, so that electrostatic latent images corresponding to an image signal are formed on the photosensitive drums 1*a* to 1*d*, respectively. The developing devices 3*a* to 3*d* include the developing rollers 26 disposed to face the photosensitive drums 1*a* to 1*d*, respectively, and in the developing rollers 26, prescribed amounts of two-component developing agents containing toner of respective colors of yellow, cyan, magenta, and black are filled, respectively. By the developing rollers 26 of the developing devices 3*a* to 3*d*, the toner is supplied onto the photosensitive drums 1*a* to 1*d*, respectively, and electrostatically adheres thereto, and thus toner images corresponding to the electrostatic latent images formed by exposure from the exposure unit 4 are formed thereon.

Then, by the primary transfer rollers 6*a* to 6*d*, between each of the primary transfer rollers 6*a* to 6*d* and a corresponding one of the photosensitive drums 1*a* to 1*d*, an electric field is imparted at a prescribed transfer voltage to cause the toner images of yellow, cyan, magenta, and black on the photosensitive drums 1*a* to 1*d* to be primarily transferred onto the intermediate transfer belt 8. These images of the four colors are formed in a prescribed positional relationship preset for the formation of a prescribed full-color image. After that, in preparation for succeeding formation of new electrostatic latent images, toner remaining on the surfaces of the photosensitive drums 1*a* to 1*d* is removed by the cleaning devices 5*a* to 5*d*, respectively, and residual electric charge is removed by a static elimination lamp (not shown).

The intermediate transfer belt 8 is laid across a plurality of suspension rollers including a driven roller 10 and a drive roller 11. When, as the drive roller 11 is driven to rotate by a drive motor (not shown), the intermediate transfer belt 8 starts to rotate in the clockwise direction, at a prescribed timing, a sheet of the transfer paper P is conveyed from the registration roller pair 12*b* to the secondary transfer roller 9 provided adjacently to the intermediate transfer belt 8, and at a nip portion (secondary transfer nip portion) between the intermediate transfer belt 8 and the secondary transfer roller 9, a full-color toner image is secondarily transferred onto the sheet of the transfer paper P. The sheet of the transfer paper P onto which the toner image has been transferred is conveyed to the fixing portion 7.

The sheet of the transfer paper P conveyed to the fixing portion 7 is heated and pressed when passing through a nip portion (fixing nip portion) between respective rollers of a fixing roller pair 13, and thus the toner image is fixed onto a surface of the sheet of the transfer paper P to form the prescribed full-color image thereon. A conveying direction of the sheet of the transfer paper P on which the full-color image has been formed is controlled by a branching portion 14 branching off in a plurality of directions. In a case where it is intended to form an image only on one side of the sheet of the transfer paper P, the sheet of the transfer paper P is directly ejected onto an ejection tray 17 by an ejection roller pair 15.

On the other hand, in a case where it is intended to form images on both sides of the sheet of the transfer paper P, a part of the sheet of the transfer paper P after having passed through the fixing portion 7 is once made to protrude from the ejection roller pair 15 to the outside of the apparatus. After that, the ejection roller pair 15 is made to rotate inversely so that, at the branching portion 14, the sheet of the transfer paper P is led into a reverse conveying path 18 along which the sheet of the transfer paper P is conveyed, with one side thereof on which the image has been formed turned upside down, again to the registration roller pair 12*b*. Then, by the secondary transfer roller 9, images to be transferred next, which have been formed on the intermediate transfer belt 8, are transferred onto the other side of the sheet of the transfer paper P, on which no image has been formed. The sheet of the transfer paper P onto which a toner image has thus been transferred is conveyed to the fixing portion 7, where the toner image is fixed, and then is ejected onto the ejection tray 17.

Figure 5:
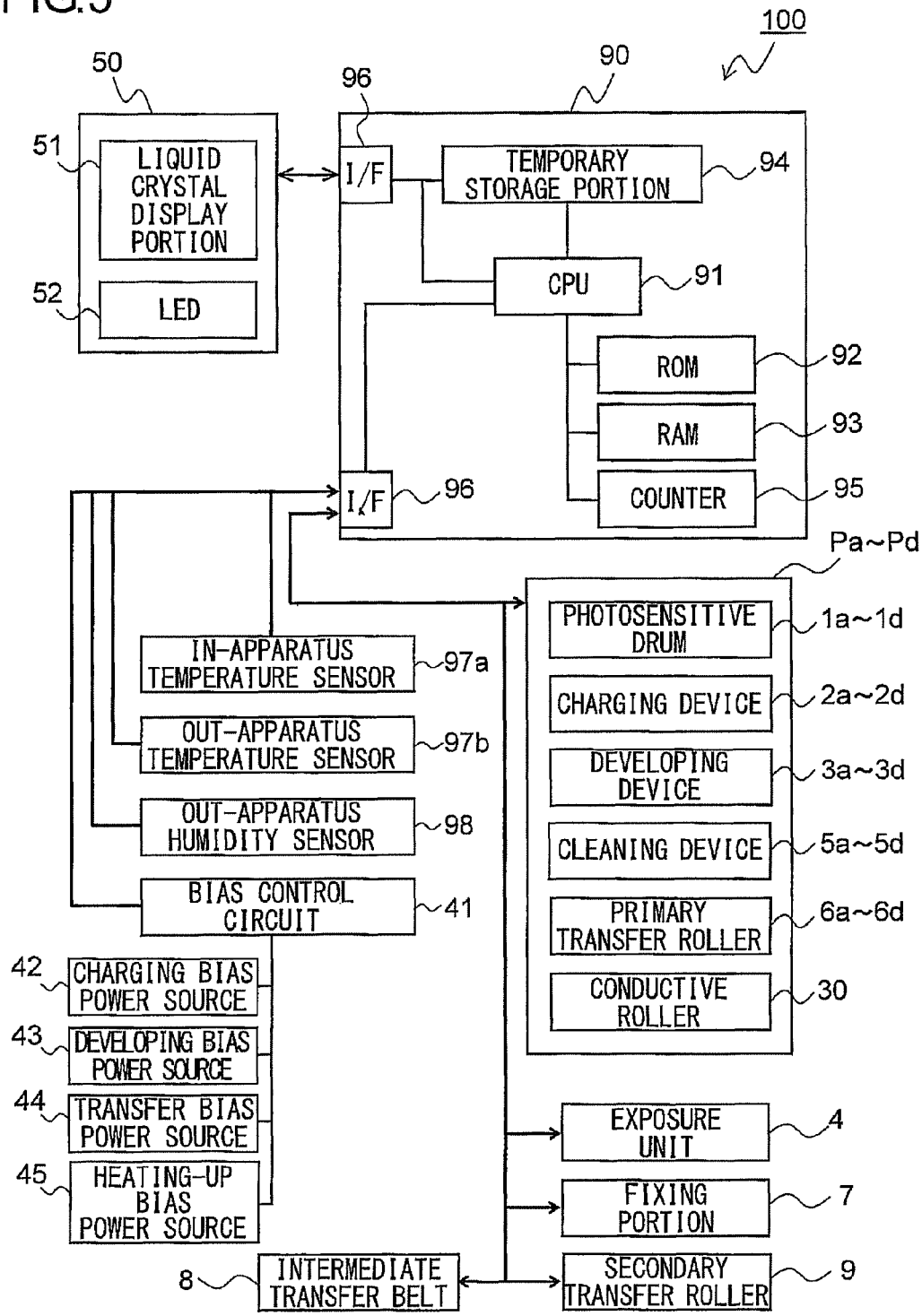
FIG. 5 is a block diagram showing a control route of the color printer 100 of the first embodiment.

The description is directed next to a control route of an image forming apparatus of the present disclosure. FIG. 5 is a block diagram for explaining one embodiment of a controller used in the color printer 100 of the first embodiment of the present disclosure. In using the color printer 100, various forms of control are performed with respect to the various portions of the apparatus, which renders a control route of the color printer 100 as a whole complicated. Herein, the description, therefore, is focused on parts of the control route required for implementing the present disclosure.

A control portion 90 includes at least a CPU (central processing unit) 91 as a central computation device, a ROM (read-only memory) 92 that is a read-only storage portion, a RAM (random access memory) 93 that is a readable and rewritable storage portion, a temporary storage portion 94 that temporarily stores image data and so on, a counter 95, and a plurality of I/Fs (interfaces) 96 that transmit control signals to the various devices in the color printer 100 and receive an input signal from an operation portion 50. Furthermore, the control portion 90 can be disposed at an arbitrary location inside the main body of the color printer 100.

In the ROM 92, programs for controlling the color printer 100, numerical values required for the control, data not to be changed during use of the color printer 100, and so on are contained. In the RAM 93, necessary data generated when control of the color printer 100 is in progress, data temporarily required for controlling the color printer 100, and so on are stored. The counter 95 counts the number of printed sheets. Instead of separately providing the counter 95, for example, the RAM 93 may be configured to store the number of printed sheets.

Furthermore, the control portion 90 transmits control signals from the CPU 91 to the various portions and devices in the color printer 100 via the I/Fs 96. Furthermore, from the various portions and devices, signals representing respective states thereof and input signals therefrom are transmitted to the CPU 91 via the I/Fs 96. The various portions and devices the control portion 90 controls in this embodiment include, for example, the image forming portions Pa to Pd, the exposure unit 4, the primary transfer rollers 6*a* to 6*d*, the fixing portion 7, the secondary transfer roller 9, an image input portion 40, a bias control circuit 41, and the operation portion 50.

The image input portion 40 is a reception portion that receives image data transmitted from a personal computer or the like to the color printer 100. An image signal inputted from the image input portion 40 is converted into a digital signal, which then is sent out to the temporary storage portion 94.

The bias control circuit 41 is connected to a charging bias power source 42, a developing bias power source 43, a transfer bias power source 44, and the heating-up bias power source 45 and, based on an output signal from the control portion 90, operates the power sources 42 to 45. Based on control signals from the bias control circuit 41, the power sources 42 to 45 are controlled so that the charging bias power source 42 applies a prescribed bias to the charging roller 22 in each of the charging devices 2*a* to 2*d*, the developing bias power source 43 applies a prescribed bias to the magnetic roller 25 and the developing roller 26 in each of the developing devices 3*a* to 3*d*, the transfer bias power source 44 applies a prescribed bias to the primary transfer rollers 6*a* to 6*d* and the secondary transfer roller 9, and the heating-up bias power source 45 applies a prescribed bias to the conductive roller 30 in each of the photosensitive drums 1*a* to 1*d*.

While, herein, the heating-up bias power source 45 for applying a bias to the conductive roller 30 is provided, a configuration also is possible in which, instead of providing the heating-up bias power source 45, for example, the charging bias power source 42 that applies a bias to the charging roller 22 is used to apply a bias to the conductive roller 30.

In the operation portion 50, a liquid crystal display portion 51 and an LED 52 that indicates various types of states are provided to indicate a state of the color printer 100 and to display a status of progress of image formation and the number of printed sheets. Various types of settings of the color printer 100 are performed from a printer driver of a personal computer.

In addition to the above, the operation portion 50 is provided with a stop/clear button that is used for, for example, halting image formation, a reset button that is used for bringing the various types of settings of the color printer 100 back to a default state, and so on.

An in-apparatus temperature sensor 97*a* detects a temperature inside the color printer 100, particularly, a temperature of the surface or a vicinity of each of the photosensitive drums 1*a* to 1*d* and is disposed in proximity to the image forming portions Pa to Pd. An out-apparatus temperature sensor 97*b* detects a temperature outside the color printer 100, and an out-apparatus humidity sensor 98 detects a humidity outside the color printer 100. The out-apparatus temperature sensor 97*b* and the out-apparatus humidity sensor 98 are installed, for example, in a neighborhood of an air suction duct (not shown) on a lateral side of the paper sheet cassette 16 shown in FIG. 1, which is unlikely to be affected by a heat generating portion, and can also be installed at any other location where a temperature or a humidity outside the color printer 100 can be detected with accuracy.

The color printer 100 of this embodiment is capable of executing a heating-up mode in which, to the conductive roller 30 that makes contact with the inner peripheral surface of each of the photosensitive drums 1*a* to 1*d*, a bias including an alternating current (AC) bias is applied to cause the surface of each of the photosensitive drums 1*a* to 1*d* to be heated up.

There is a large difference in electric resistance between the metallic shaft 30*a* and the roller body 30*b* made of a conductive material such as an epichlorohydrin rubber, which constitute the conductive roller 30. Because of this, when an alternating current bias is applied to the conductive roller 30, heat is generated between the shaft 30*a* and the roller body 30*b* or inside the roller body 30*b*. The heat generated in the conductive roller 30 is conducted to each of the photosensitive drums 1*a* to 1*d* and heats up the surface of each of the photosensitive drums 1*a* to 1*d*.

Furthermore, another possible principle based on which the surface of each of the photosensitive drums 1*a* to 1*d* heats up is as follows. That is, the conductive roller 30 and the photosensitive drums 1*a* to 1*d* are formed of a dielectric substance. A relationship between the conductive roller 30 and each of the photosensitive drums 1*a* to 1*d* is expressed by an equivalent circuit of a capacitor and a resistor shown in FIG. 6. When an electric field is applied to a dielectric substance, electrons and ions and so on present inside the dielectric substance are polarized, and resulting dipoles of positive and negative polarities attempt to be aligned in orientation with the electric field. In an electric field of a high-frequency alternating current of several Hz to several hundreds of MHz, in which polarities are reversed millions of times per second, friction due to vigorous motion of the dipoles attempting to follow such reversals of the electric field causes heat to be generated.

Figure 6:
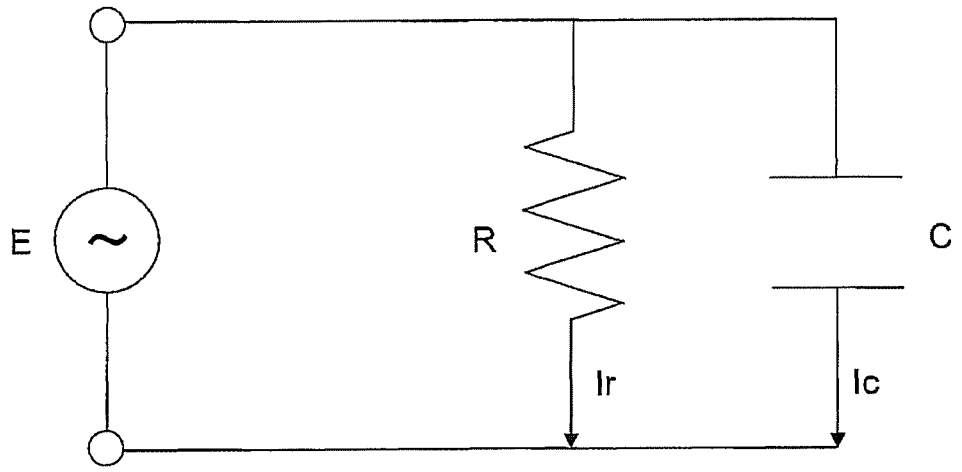
FIG. 6 is a diagram showing an equivalent circuit for explaining a principle based on which photosensitive drums 1*a* to 1*d* heat up by application of an alternating current bias to a conductive roller 30.

For example, in the equivalent circuit of each of the photosensitive drums 1*a* to 1*d* and the conductive roller 30 shown in FIG. 6, where an alternating current bias to be applied is denoted as E, a frequency as f, a resistance of a system as a whole as R, and a capacitance as C, with respect to Ir in phase with the application bias E, there occurs heat generation expressed by P=E Ir.

Herein, where an angular frequency $\omega=2\pi f$ and $|Ir(j\omega)|/|Ic(j\omega)|=\tan\delta$, $\tan\delta=1/(2\pi f\cdot CR)$ and $1/R=2\pi f\cdot C\cdot\tan\delta$ are obtained. A power P required for heat generation, therefore, is expressed by $P=E\cdot|Ir(j\omega)|=E\hat{}2/R=E\hat{}2\cdot(2\pi f\cdot C\cdot\tan\delta)$. Based on this, it can be said that heating-up is proportional to a square of the application bias E, the frequency f, and the capacitance C.

With this configuration, the photosensitive drums 1*a* to 1*d* themselves heat up, and thus compared with the method in which a heater is disposed inside or outside each of the photosensitive drums 1*a* to 1*d*, no energy is wasted by heating even unintended objects such as the atmosphere (air) in the vicinity of each of the photosensitive drums 1*a* to 1*d*, thus enabling efficient heating-up. In a case where a direct current (DC) bias is used as a bias to be applied to the conductive roller 30, a resulting heating-up effect is none or extremely small, and thus it is required that an alternating current bias be applied.

Herein, a configuration also is possible in which, to the charging roller 22 that makes contact with the surface of each of the photosensitive drums 1*a* to 1*d*, a bias including an alternating current bias is applied to cause the photosensitive drums 1*a* to 1*d* to be heated up. Since, however, the photosensitive layer is formed on the surface of each of the photosensitive drums 1*a* to 1*d*, when an excessive alternating current bias is applied to the charging roller 22, there is a possibility that exchange of discharged electric charge promotes electrostatic destruction (breakdown) of the photosensitive layer, leading to the occurrence of an image defect such as color spots or color streaks. In the color printer 100 of the present disclosure, a bias is applied to the conductive roller 30 that makes contact with the inner peripheral surface of each of the photosensitive drums 1*a* to 1*d*, and thus the photosensitive drums 1*a* to 1*d* can be heated up while any adverse effect on the photosensitive layer formed on the surface of each of the photosensitive drums 1*a* to 1*d* is suppressed.

Moreover, in this embodiment, the insulation layer 35 is formed on the inner peripheral surface of each of the photosensitive drums 1*a* to 1*d*. Thus, there occurs no electrical discharge between the inner peripheral surface of each of the photosensitive drums 1*a* to 1*d* and the conductive roller 30, so that the photosensitive drums 1*a* to 1*d* can be heated up without causing electrostatic destruction of the photosensitive layer on the surface of each of the photosensitive drums 1*a* to 1*d*. This also avoids the possibility that an image defect such as color spots or color streaks occurs.

As for a timing for executing the heating-up mode, preferably, the heating-up mode is executed at the time of non-image formation, for example, when the color printer 100 is started up from a power off state or a sleep (power saving) mode to a printing start state. In a case where the color printer 100 is in the power off state or the sleep mode, the vicinity of each of the photosensitive drums 1*a* to 1*d* is at a temperature decreased to room temperature, and this is a condition where image deletion is likely to occur due to condensation taking place on the photosensitive drums 1*a* to 1*d*. Hence, by executing the heating-up mode at the above-described timing, image deletion can be effectively suppressed.

Furthermore, in a condition where image deletion is particularly likely to occur, such as under a low-temperature and high-humidity environment, the heating-up mode may be continued also at the time of image formation. Since, as shown in FIGS. 3 and 4, the insulation layer 35 is formed on the inner peripheral surface of each of the photosensitive drums 1*a* to 1*d*, even when a bias is applied to the conductive roller 30 during image formation, there is no possibility that such bias application affects an electrostatic image or a toner image on the surface of each of the photosensitive drums 1*a* to 1*d*.

Next, a relationship between whether or not the photosensitive drums 1*a* to 1*d* are driven to rotate and a heating-up effect on the photosensitive drums 1*a* to 1*d* was studied. In a tandem-type color printer 100 as shown in FIG. 1, as each of photosensitive drums 1*a* to 1*d*, an a-Si photosensitive member formed by layering an a-Si photosensitive layer on a surface of an aluminum elementary pipe having an outer diameter of 30 mm and a thickness of 2 mm was used, and a conductive roller 30 having an outer diameter of 12 mm and a thickness of 2 mm was brought in contact therewith. At this time, a photosensitive drum-conductive roller system as a whole had a capacitance C of 600 pF and a resistance R of 1.3 MΩ.

Furthermore, as a charging bias to be applied to the conductive roller 30 in the heating-up mode, a bias obtained by superimposing an alternating current bias having a peak-to-peak value (Vpp)=1600 V on a direct current bias (Vdc) of 350 V was set.

Figure 7:
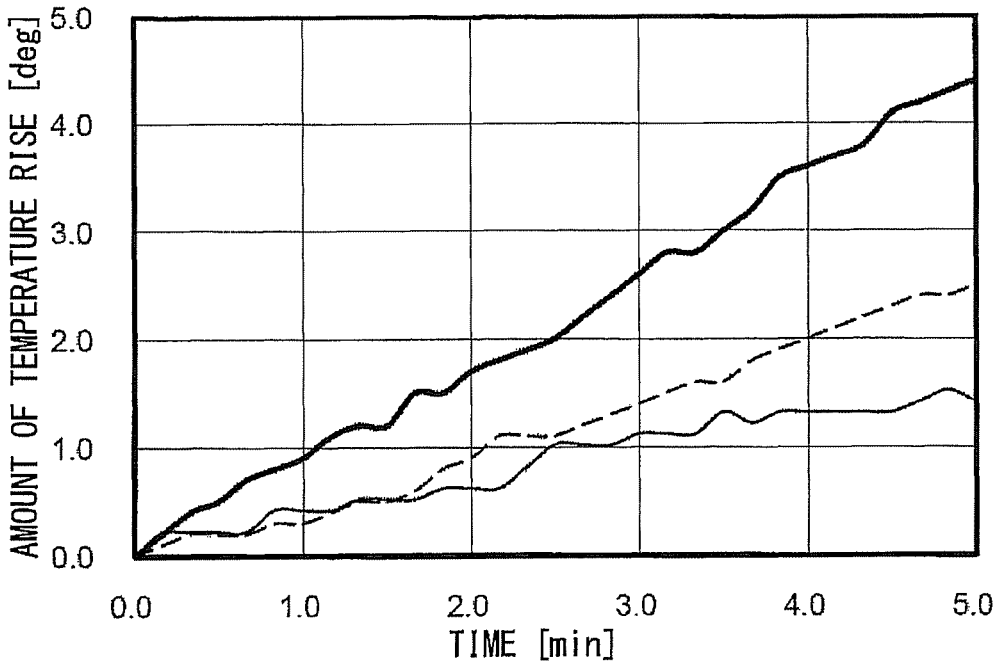
FIG. 7 is a graph showing an amount of temperature rise of the photosensitive drums 1*a* to 1*d* when a heating-up mode is executed in a state where the photosensitive drums 1*a* to 1*d* are driven to rotate at the same linear velocity as that used in a printing operation, in a state where the photosensitive drums 1*a* to 1*d* are driven to rotate at a linear velocity half that used in the printing operation, and in a state where the photosensitive drums 1*a* to 1*d* are stopped from rotating.

Then, there were measured variations in amount of temperature rise of a surface of each of the photosensitive drums 1*a* to 1*d* when, under an environment of 28° C. and 80% RH, the heating-up mode was executed in a state where the photosensitive drums 1*a* to 1*d* were driven to rotate at the same linear velocity (157 mm/sec) as that used in a printing operation, in a state where the photosensitive drums 1*a* to 1*d* were driven to rotate at a linear velocity (78.5 mm/sec) half that used in the printing operation, and in a state where the photosensitive drums 1*a* to 1*d* were stopped from rotating. FIG. 7 shows a result thereof.

As shown in FIG. 7, in a case where the heating-up mode was executed in the state where the photosensitive drums 1*a* to 1*d* were stopped from rotating (a thick line in FIG. 7), an amount of temperature rise in five minutes of the surface of each of the photosensitive drums 1*a* to 1*d* was 4.0 degrees or more. On the other hand, in a case where the heating-up mode was executed in the state where the photosensitive drums 1*a* to 1*d* were made to rotate at a linear velocity half that used in the printing operation (a broken line in FIG. 7), the amount of temperature rise in five minutes of the surface of each of the photosensitive drums 1*a* to 1*d* was 2.5 degrees, and in a case where the heating-up mode was executed in the state where the photosensitive drums 1*a* to 1*d* were made to rotate at the same linear velocity as that used in the printing operation (a solid line in FIG. 7), the amount of temperature rise in five minutes of the surface of each of the photosensitive drums 1*a* to 1*d* was 1.5 degrees. Conceivably, this is attributed to the fact that, when an alternating current bias is applied to the conductive roller 30 while the photosensitive drums 1*a* to 1*d* are made to rotate, the photosensitive drums 1*a* to 1*d* are undesirably cooled by airflow generated around the photosensitive drums 1*a* to 1*d*, so that heating-up efficiency is deteriorated.

Furthermore, the conductive roller 30 is making contact not with the surface (outer peripheral surface) of each of the photosensitive drums 1*a* to 1*d* on which the photosensitive layer is formed but with the inner peripheral surface thereof on which the insulation layer 35 is formed. Thus, even when an alternating current bias is applied to the conductive roller 30 in the state where the photosensitive drums 1*a* to 1*d* are stopped from rotating, there occurs no image defect due to electrical discharge being concentrated at a portion of each of the photosensitive drums 1*a* to 1*d* where contact is made with the conductive roller 30. For this reason, preferably, the heating-up mode is executed in the state where the photosensitive drums 1*a* to 1*d* are stopped from rotating.

Next, a relationship between a factor of an alternating current bias to be applied to the conductive roller 30 and a heating-up effect on the photosensitive drums 1*a* to 1*d* was studied. Specifications of the photosensitive drums 1*a* to 1*d* and the conductive roller 30 of the color printer 100 were set to be similar to those in the foregoing study. Furthermore, a bias to be applied to the conductive roller 30 in the heating-up mode also was set similarly to that in the foregoing study.

Figure 8:
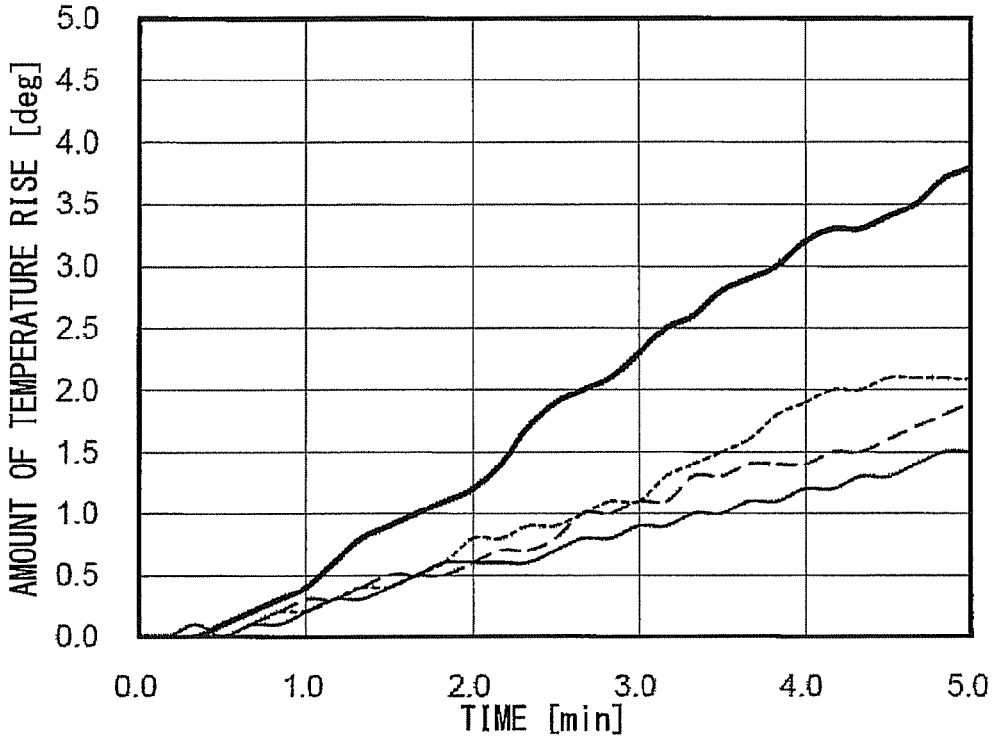
FIG. 8 is a graph showing an amount of temperature rise of the photosensitive drums 1*a* to 1*d* when the heating-up mode is executed while a frequency f of an alternating current bias to be applied to the conductive roller 30 is made to vary.

Then, there were measured variations in amount of temperature rise of the surface of each of the photosensitive drums 1*a* to 1*d* when, under an environment of 28° C. and 80% RH, the heating-up mode was executed in a state where the photosensitive drums 1*a* to 1*d* were stopped from rotating, and a frequency f of an alternating current bias to be applied to the conductive roller 30 was made to vary in a range of 2400 Hz to 5000 Hz. FIG. 8 shows a result thereof. In FIG. 8, an amount of temperature rise at the frequency f of 2400 Hz is indicated by a solid line, an amount of temperature rise at the frequency f of 3000 Hz by a broken line, an amount of temperature rise at the frequency f of 4000 Hz by a dotted line, and an amount of temperature rise at the frequency f of 5000 Hz by a thick line.

As is evident from FIG. 8, the higher the frequency f of an alternating current bias to be applied to the conductive roller 30, the larger the amount of temperature rise of the surface of each of the photosensitive drums 1*a* to 1*d*. It is known that a relative humidity at which no image deletion occurs is 70% or lower, and in order for a relative humidity to be decreased to 70% or lower under the environment of 28° C. and 80% RH, it is required that the photosensitive drums 1*a* to 1*d* be heated up to a surface temperature of 30.2° C. or higher.

To this end, a target value of the amount of temperature rise is set to (30.2-28.0)=2.2 (deg.), in which case it is found from FIG. 8 that a length of time required for heating-up is 2.8 minutes at the frequency f of 5000 Hz, 4.2 minutes at the frequency f of 4000 Hz, and 5 minutes or more at the frequency f of 3000 Hz or lower. Normally, in the color printer 100, a length of time required for warm-up is set to about 5 minutes. Based on this, under the environment of 28° C. and 80% RH, the frequency f is set to 4000 Hz or higher, and thus the photosensitive drums 1*a* to 1*d* can be heated up, within the length of time required for warm-up, to a surface temperature at which no image deletion occurs.

Furthermore, an amount of temperature rise of the surface of each of the photosensitive drums 1*a* to 1*d* required for preventing image deletion varies depending on a surrounding environment (temperature and humidity) of the color printer 100. For this reason, an environment correction table in which an optimum bias application time corresponding to each surrounding environment is preset is stored beforehand in the ROM 92 (or the RAM 93), and at the time of executing the heating-up mode, an alternating current bias is applied continuously only for a minimum length of time required for removing moisture on the surface of each of the photosensitive drums 1*a* to 1*d*. This reduces a user's waiting time as much as possible and thus can enhance image formation efficiency to a maximum extent.

Figure 9:
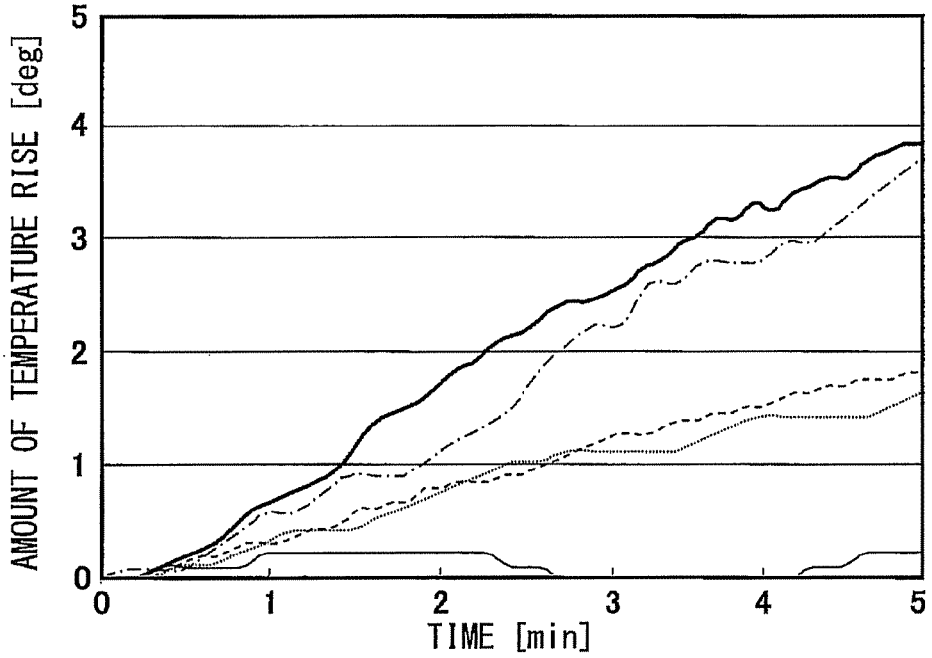
FIG. 9 is a graph showing an amount of temperature rise of the photosensitive drums 1*a* to 1*d* when the heating-up mode is executed while the frequency f and Vpp of an alternating current bias to be applied to the conductive roller 30 are made to vary.

Next, in order to set a peak-to-peak value (Vpp) of an appropriate alternating current bias to be applied to the conductive roller 30, under test conditions similar to those in the case shown in FIG. 7, there were measured variations in amount of temperature rise of the surface of each of the photosensitive drums 1*a* to 1*d* when a frequency f of an alternating current bias to be applied to the conductive roller 30 was made to vary to be 3000 Hz and 5000 Hz, and Vpp thereof was made to vary in a range of 1000 V to 1600 V. FIG. 9 shows a result thereof. In FIG. 9, with respect to the frequency f of 3000 Hz, an amount of temperature rise at Vpp of 1000 V is indicated by a solid line, an amount of temperature rise at Vpp of 1200 V by a dotted line, and an amount of temperature rise at Vpp of 1600 V by a broken line. Furthermore, with respect to the frequency f of 5000 Hz, an amount of temperature rise at Vpp of 1200 V is indicated by an alternate long and short dashed line, and an amount of temperature rise at Vpp of 1600 V by a thick line.

As is evident from FIG. 9, depending on Vpp of an alternating current bias to be applied to the conductive roller 30, a heating-up characteristic of the surface of each of the photosensitive drums 1*a* to 1*d* varies, and by applying an alternating current bias having Vpp of 1200 V, there can be obtained a heating-up effect similar to that obtained in a case where an alternating current bias having Vpp of 1600 V is applied. It is found that in a case, on the other hand, where an alternating current bias having Vpp of 1000 V is applied, almost no heating-up effect is exhibited. At this time, Vpp of 1200 V at which the heating-up effect was observed is twice as large as a discharge start voltage Vth between the conductive roller 30 and each of the photosensitive drums 1*a* to 1*d*.

The term "discharge start voltage" used in this specification is assumed to refer to a voltage value at which, when a direct current bias is applied to the conductive roller 30, and a voltage value of the direct current bias is gradually increased, electrical discharge occurs between the conductive roller 30 and each of the photosensitive drums 1*a* to 1*d*.

That is, with an alternating current bias having a value of Vpp twice or more as large as the discharge start voltage Vth set as an alternating current bias value to be applied to the conductive roller 30, the photosensitive drums 1*a* to 1*d* can be heated up. Particularly by setting Vpp of the alternating current bias to be twice as large as the discharge start voltage Vth, the photosensitive drums 1*a* to 1*d* can be heated up while a stable discharge state is maintained. As a result, while damage to the conductive roller 30 due to application of an excessive voltage thereto is suppressed to a minimum, the occurrence of image deletion can be effectively suppressed.

To summarize the results described above, at the time of executing the heating-up mode, it is necessary to apply to the conductive roller 30 an alternating current bias having a value of Vpp twice or more as large as the discharge start voltage Vth between the conductive roller 30 and each of the photosensitive drums 1*a* to 1*d*, and it is more preferable to apply thereto an alternating current bias having a frequency as high as possible.

Herein, the discharge start voltage Vth varies even depending on an environment in which the color printer 100 is installed, a resistance of the conductive roller 30, and so on. Because of this, in order to maintain constant heating-up efficiency for the photosensitive drums 1*a* to 1*d*, preferably, the discharge start voltage Vth is measured at every prescribed time interval, and based on a value of the discharge start voltage Vth thus measured, Vpp of an alternating current bias to be applied to the conductive roller 30 is determined. Furthermore, even with the same value of Vpp, the larger the frequency f, the higher a heating-up effect on the photosensitive drums 1*a* to 1*d*, and thus, preferably, the frequency f is set to a value somewhat higher than necessary so that a heating-up time (alternating current bias application time) is reduced, thereby to reduce damage to the conductive roller 30.

Figure 10:
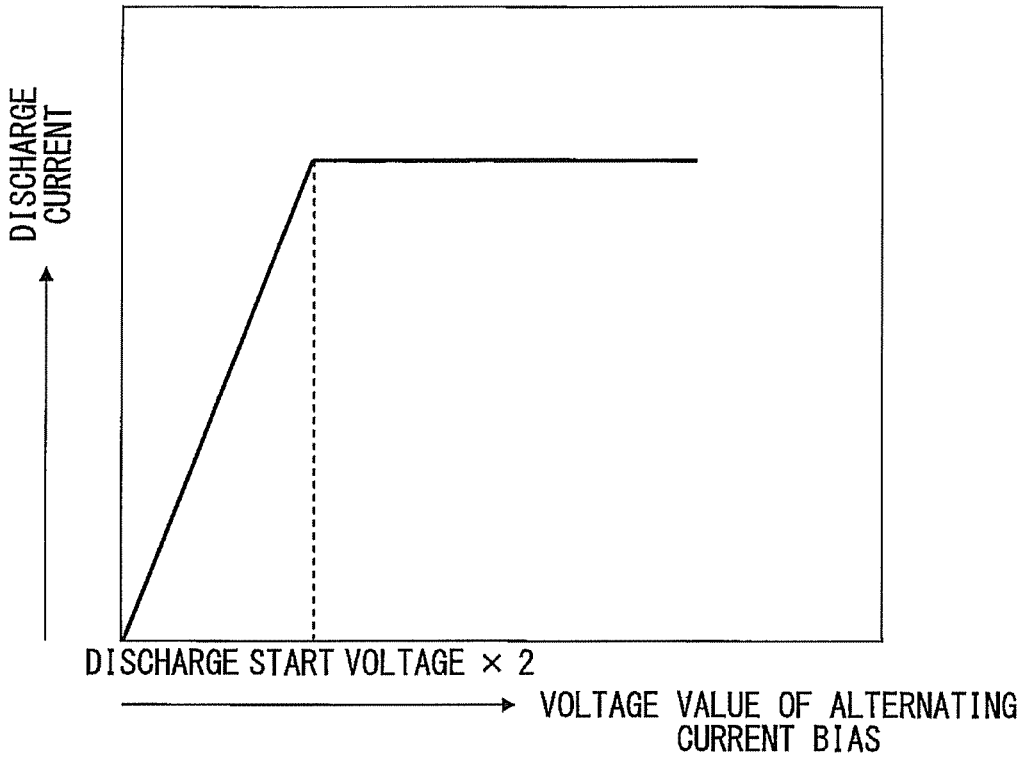
FIG. 10 is a graph showing how a discharge current changes with an increase in Vpp of an alternating current bias to be applied to the conductive roller 30.

The discharge start voltage Vth is measured by, for example, the following method. That is, when a discharge current is measured while Vpp of an alternating current bias is increased, as shown in FIG. 10, the discharge current increases in proportion to Vpp and, upon Vpp reaching a prescribed value, stops increasing to exhibit a substantially constant discharge current value. This value of Vpp as a diffraction point of the discharge current is twice as large as the discharge start voltage Vth. In addition to a discharge current value, a surface potential of the photosensitive drums 1*a* to 1*d* or the like also exhibits a tendency similar to that shown in FIG. 10, and thus it is also possible to measure the discharge start voltage Vth based on variations in surface potential of the photosensitive drums 1*a* to 1*d*.

Furthermore, when a bias is applied to a conductive member that is used in such a manner that a bias is applied thereto in a printing operation, such as the charging roller 22, also at a time other than in the printing operation, there is a possibility that degradation of the conductive member is accelerated to shorten a service life. When, however, a member to which no bias is applied in the printing operation, such as the conductive roller 30, is used, it is no longer required to take into consideration a service life being shortened due to application of a bias.

By the way, in many cases, the conductive roller 30 is formed by fastening, with the use of an adhesive, the roller body 30*b* made of a conductive material to the metallic shaft 30*a*, and therefore, when a high-frequency alternating current bias is applied thereto, there is a possibility that partial exfoliation of the adhesive occurs. As a solution to this, there is used the conductive roller 30 formed by fastening, without the use of an adhesive, the roller body 30*b* to the shaft 30*a*. In this case, when a high-frequency alternating current bias is applied thereto, there occurs no exfoliation between the roller body 30*b* and the shaft 30*a*, and the photosensitive drums 1*a* to 1*d* can be heated up in a short time. As a method for fastening, without the use of an adhesive, the roller body 30*b* to the shaft 30*a*, for example, there is used a method in which the shaft 30*a* is press-inserted into the roller body 30*b* and fastened therein.

Next, a description is given of a color printer 100 according to a second embodiment of the present disclosure. A configuration and a control route of the color printer 100 are similar to those in the first embodiment shown in FIGS. 1 to 5. In the color printer 100 of this embodiment, at the time of executing a heating-up mode, an alternating current bias having such a high frequency that no electrical discharge occurs between a conductive roller 30 and each of photosensitive drums 1*a* to 1*d* is applied to the conductive roller 30.

In a conductive material constituting a roller body 30*b* of the conductive roller 30, an ion conductive agent is used, and when a frequency f of an alternating current bias is set to a high frequency of a given value or higher, ions in the conductive material can no longer oscillate following the frequency f, so that electrical discharge no longer occurs.

Table 1 shows a relationship between a length of time it takes for a surface of each of the photosensitive drums 1*a* to 1*d* to be heated to reach a target temperature (herein, 30.2° C.) when the frequency f of an alternating current bias is made to vary from 4 kHz through 10 kHz and damage to the conductive roller 30 when the alternating current bias is applied thereto for a prescribed length of time. In Table 1, damage to the conductive roller 30 was determined by visually observing a surface of the conductive roller 30, and a level at which the magnitude of damage caused is practically problematic is denoted as "Highly Observed", a level at which damage is observed but the magnitude thereof is not practically problematic as "Observed", and a level at which no damage is observed as "Not Observed".

TABLE 1

| Frequency | Heating-up Speed for Attaining Target Temperature | Damage to Conductive Roller |
|---|---|---|
| 4 kHz | 4.2 mins. | Highly Observed |
| 6 kHz | 2.5 mins. | Highly Observed |
| 8 kHz | 2.1 mins. | Observed |
| 10 kHz | 2.0 mins. | Not Observed |

As shown in Table 1, it has been confirmed that as the frequency f becomes higher, a heating-up speed at which the surface of each of the photosensitive drums 1*a* to 1*d* is heated up becomes faster, and at the frequency f of 8 kHz or higher, damage to the conductive roller 30 is also reduced.

From this viewpoint, in this embodiment, by making use of a frequency characteristic described above, an alternating current bias having such a high frequency that no electrical discharge occurs between the conductive roller 30 and each of the photosensitive drums 1*a* to 1*d* is applied to the conductive roller 30, and thus the photosensitive drums 1*a* to 1*d* can be heated up, with only oscillations of electrons and ions caused. As a result, while damage to the conductive roller 30 is suppressed to a minimum, the occurrence of image deletion can be effectively suppressed.

Next, a description is given of a color printer 100 according to a third embodiment of the present disclosure. A configuration and a control route of the color printer 100 are similar to those in the first embodiment shown in FIGS. 1 to 5. In the color printer 100 of this embodiment, at the time of executing a heating-up mode, in addition to an alternating current bias, a direct current bias not higher than a discharge start voltage Vth between a conductive roller 30 and each of photosensitive drums 1*a* to 1*d* is applied to the conductive roller 30.

Figure 11:
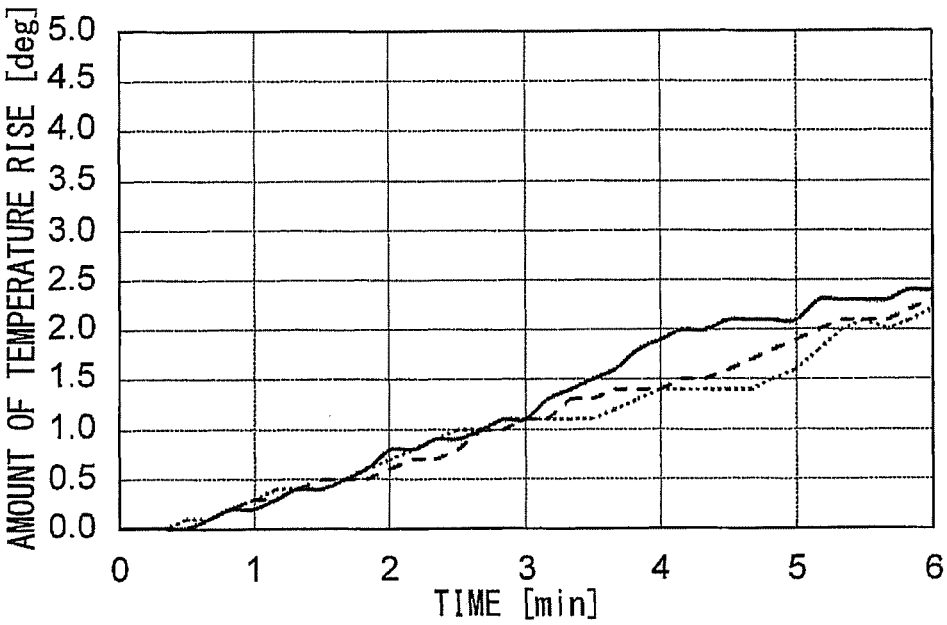
FIG. 11 is a graph showing variations in amount of temperature rise of a surface of each of the photosensitive drums 1*a* to 1*d* when the frequency f of an alternating current bias to be applied to the conductive roller 30 is fixed to 3000 Hz, Vpp thereof is fixed to 1600 V, and a direct current bias Vdc to be applied thereto is made to vary in three stages at 0, 350 V, and 500 V.
Figure 12:
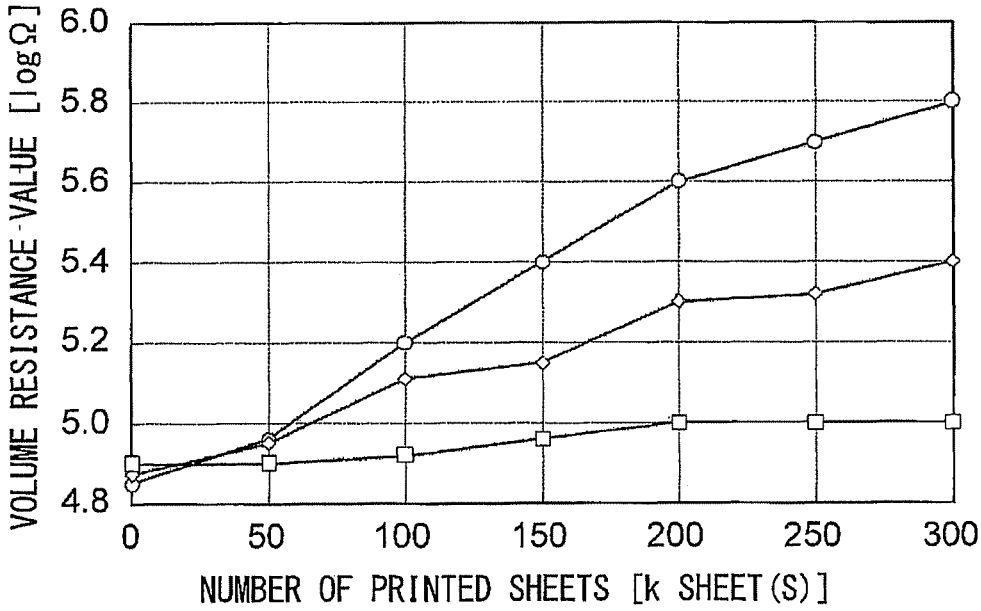
FIG. 12 is a graph showing variations in volume resistance value of the conductive roller 30 after durability printing when the frequency f of an alternating current bias to be applied to the conductive roller 30 is fixed to 3000 Hz, Vpp thereof is fixed to 1600 V, and the direct current bias Vdc to be applied thereto is made to vary in three stages at 0, 350 V, and 500 V.

FIGS. 11 and 12 are graphs respectively showing variations in amount of temperature rise of a surface of each of the photosensitive drums 1*a* to 1*d* and variations in volume resistance value of the conductive roller 30 after durability printing, when a frequency f of an alternating current bias to be applied to the conductive roller 30 is fixed to 3000 Hz, Vpp thereof is fixed to 1600 V, and a direct current bias Vdc to be applied thereto is made to vary in three stages at 0, 350 V, and 500 V. Other test conditions were set to be similar to those in the cases shown in FIGS. 7 and 8.

As shown in FIG. 11, it has been confirmed that, when the frequency f and Vpp of an alternating current bias are set to be constant, the amount of temperature rise of the surface of each of the photosensitive drums 1*a* to 1*d* is substantially constant regardless of a value of the direct current bias Vdc. It is found that, when a target value of the amount of temperature rise is set to (30.2−28.0)=2.2 (deg.), a length of time required for heating-up is about 6 minutes at any of the values of the direct current bias Vdc of 0, 350 V, and 500 V.

Furthermore, as shown in FIG. 12, it has been confirmed that as the direct current bias Vdc becomes higher, the volume resistance value of the conductive roller 30 after durability printing increases, and in a case where the direct current bias Vdc is set to 0, even after 300 k sheets (300,000 sheets) have been printed, almost no increase occurs in the volume resistance value of the conductive roller 30.

In the heating-up mode, as described earlier, an alternating current bias having periodicity is applied to the conductive roller 30 to cause the conductive roller 30 to generate heat, and a direct current bias, therefore, is not necessarily required for causing the conductive roller 30 to generate heat.

In fact, applying the direct current bias Vdc causes an ion conductive agent in a roller body 30*b* of the conductive roller 30 to undesirably flow out toward the photosensitive drums 1*a* to 1*d*, resulting in an increase in voltage resistance value of the conductive roller 30. As a result, a service life of the conductive roller 30 is shortened.

Figure 13:
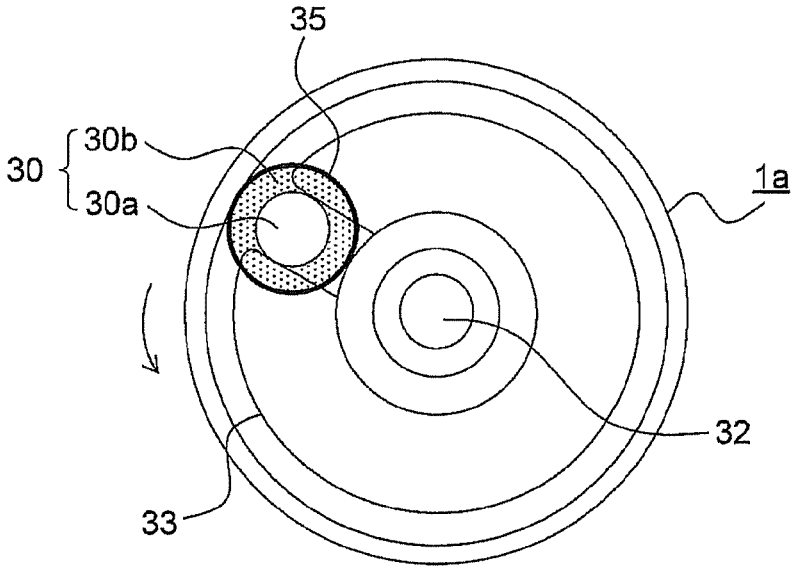
FIG. 13 is a sectional side view of a vicinity of an end portion of a photosensitive drum 1*a* in a color printer 100 according to a fourth embodiment of the present disclosure, taken in a direction perpendicular to an axial direction of the photosensitive drum 1*a*.
Figure 14:
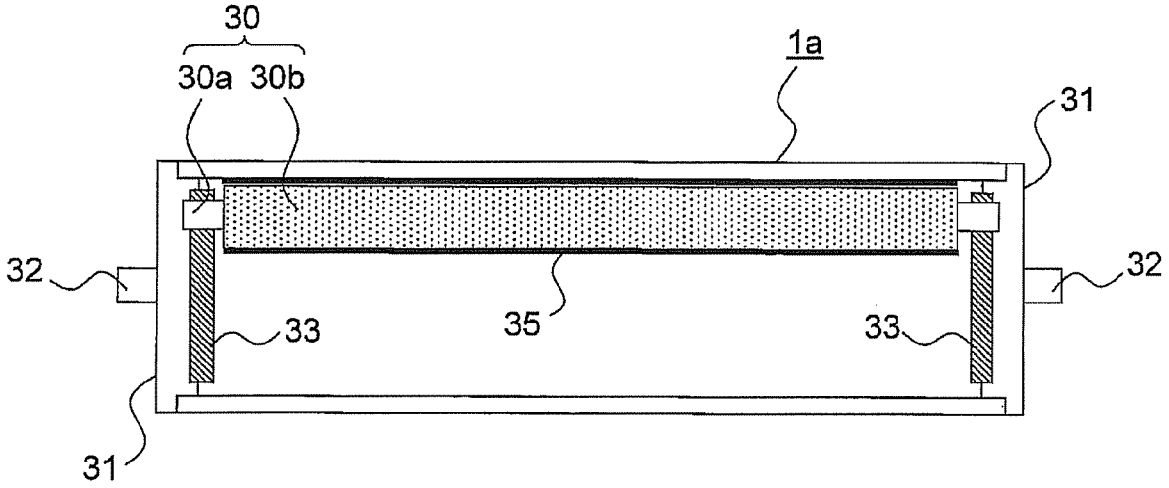
FIG. 14 is a sectional side view of the photosensitive drum 1*a* in the color printer 100 of the fourth embodiment, taken along the axial direction.

As a solution to the above, this embodiment adopts a configuration in which a direct current bias to be applied to the conductive roller 30 at the time of executing the heating-up mode is set to be as low as possible so that degradation of the conductive roller 30 is suppressed. To be specific, a direct current bias to be applied to the conductive roller 30 is set to be not higher than the discharge start voltage Vth, and thus the service life of the conductive roller 30 can be secured. Furthermore, when a direct current bias to be applied to the conductive roller 30 at the time of executing the heating-up mode is set to 0, degradation of the conductive roller 30 can be further suppressed Next, a description is given of a color printer 100 according to a fourth embodiment of the present disclosure. With regard to a photosensitive drum 1*a* in the color printer 100 of the fourth embodiment, FIG. 13 is a sectional side view of a vicinity of an end portion of the photosensitive drum 1*a* taken in a direction perpendicular to an axial direction of the photosensitive drum 1*a*, and FIG. 14 is a sectional side view of the photosensitive drum 1*a* taken along the axial direction. An overall configuration and a control route of the color printer 100 are similar to those in the first embodiment shown in FIGS. 1, 2, and 5.

As shown in FIGS. 13 and 14, in the color printer 100 of this embodiment, an insulation layer 35 is formed on an outer peripheral surface of a roller body 30*b* that is a constituent of a conductive roller 30. With this configuration, there occurs no electrical discharge between an inner peripheral surface of each of the photosensitive drums 1*a* to 1*d* and the conductive roller 30, and thus, similarly to the first embodiment, the photosensitive drums 1*a* to 1*d* can be heated up without causing electrostatic destruction of a photosensitive layer on a surface of each of the photosensitive drums 1*a* to 1*d*. This also avoids the possibility that an image defect such as color spots or color streaks occurs. Furthermore, even when a bias is applied to the conductive roller 30 at the time of image formation, there is no longer a possibility that such bias application affects an electrostatic image or a toner image on the surface of each of the photosensitive drums 1*a* to 1*d*.

As a method for forming the insulation layer 35, there is used a method in which a coating of an insulative resin is applied to the outer peripheral surface of the roller body 30*b* or a method in which an insulative resin sheet is bonded thereto. As the insulative resin, a fluorine-based resin such as PTFE (polytetrafluoroethylene) or PFA (tetrafluoroethylene-perfluoroalkyl vinyl ether copolymer), a silicone resin, or the like is used. The insulation layer 35 preferably has a resistance value of not less than $10^{10}\Omega$.

Figure 15:
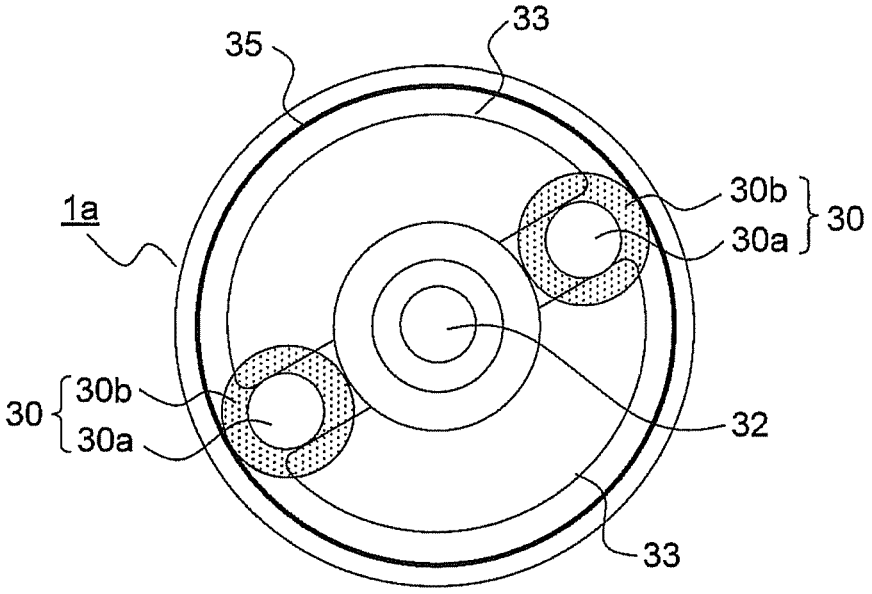
FIG. 15 is a sectional side view of a vicinity of an end portion of a photosensitive drum 1*a* in a color printer 100 according to a fifth embodiment of the present disclosure, taken in a direction perpendicular to an axial direction of the photosensitive drum 1*a*, which shows an example in which two conductive rollers 30 are disposed to face each other in the photosensitive drum 1*a*.
Figure 16:
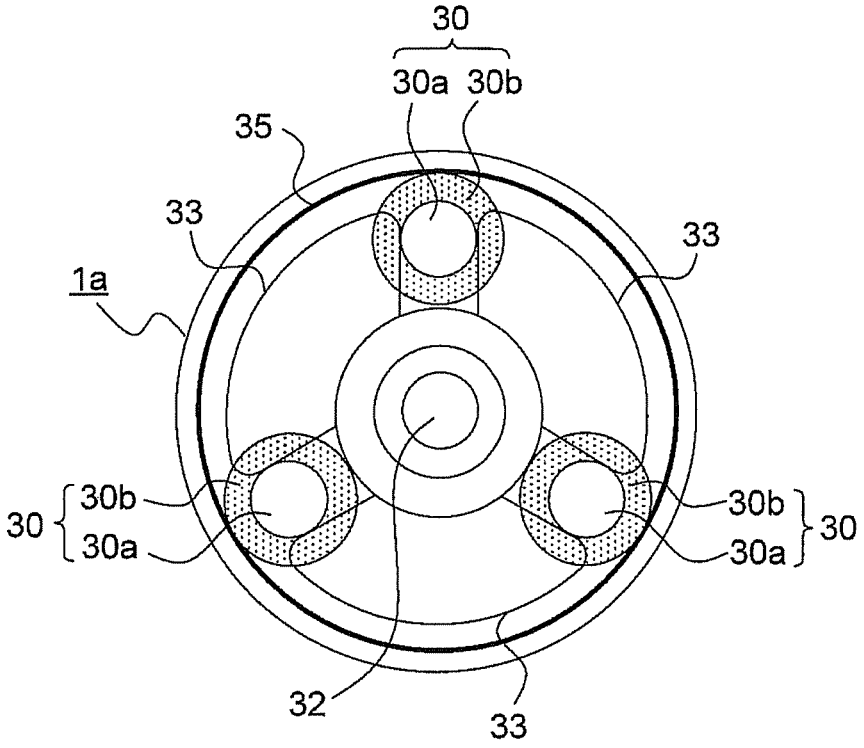
FIG. 16 is a sectional side view of the vicinity of the end portion of the photosensitive drum 1*a* in the color printer 100 of the fifth embodiment, taken in the direction perpendicular to the axial direction of the photosensitive drum 1*a*, which shows an example in which three conductive rollers 30 are disposed at equal distances from one another in the photosensitive drum 1*a*.

Next, a description is given of a color printer 100 according to a fifth embodiment of the present disclosure. With regard to a photosensitive drum 1*a* in the color printer 100 of the fifth embodiment, FIGS. 15 and 16 are sectional side views of a vicinity of an end portion of the photosensitive drum 1*a* taken in a direction perpendicular to an axial direction of the photosensitive drum 1*a*, FIG. 15 showing an example in which two conductive rollers 30 are disposed to face each other in the photosensitive drum 1*a*, and FIG. 16 showing an example in which three conductive rollers 30 are disposed at equal distances from one another in the photosensitive drum 1*a*. In this embodiment, a heating-up mode is executed by applying a bias including an alternating current bias to the plurality of conductive rollers 30 that make contact with an inner peripheral surface of each of the photosensitive drums 1*a* to 1*d*.

According to a configuration of this embodiment, an alternating current bias is applied to the plurality of conductive rollers 30 that make contact with each of the photosensitive drums 1*a* to 1*d*, and thus compared with a configuration in which, as in the first to fourth embodiments, an alternating current bias is applied only to a single conductive roller 30, a heating-up time for heating up a surface of each of the photosensitive drums 1*a* to 1*d* is reduced, so that a user's waiting time can be reduced.

Furthermore, by disposing the plurality of conductive rollers 30 at equal distances from one another as shown in FIGS. 15 and 16, the surface of each of the photosensitive drums 1*a* to 1*d* can be uniformly heated up. Moreover, a rotational load of the photosensitive drums 1*a* to 1*d* resulting from contact with the conductive rollers 30 also is equalized in a circumferential direction, and thus the photosensitive drums 1*a* to 1*d* can be driven to rotate smoothly.

While in this embodiment, similarly to the first embodiment, an insulation layer 35 is formed on the inner peripheral surface of each of the photosensitive drums 1*a* to 1*d*, a configuration also is possible in which, similarly to the second embodiment, the insulation layer 35 is formed on an outer peripheral surface of each of the conductive rollers 30. The insulation layer 35 is formed by a method similar to that used in the first and second embodiments.

Figure 17:
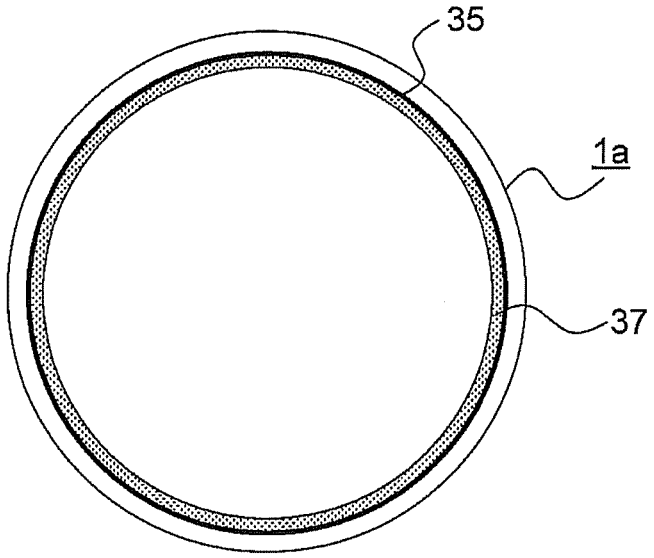
FIG. 17 is a sectional side view of a vicinity of an end portion of a photosensitive drum 1*a* in a color printer 100 according to a sixth embodiment of the present disclosure, taken in a direction perpendicular to an axial direction of the photosensitive drum 1*a*.
Figure 18:
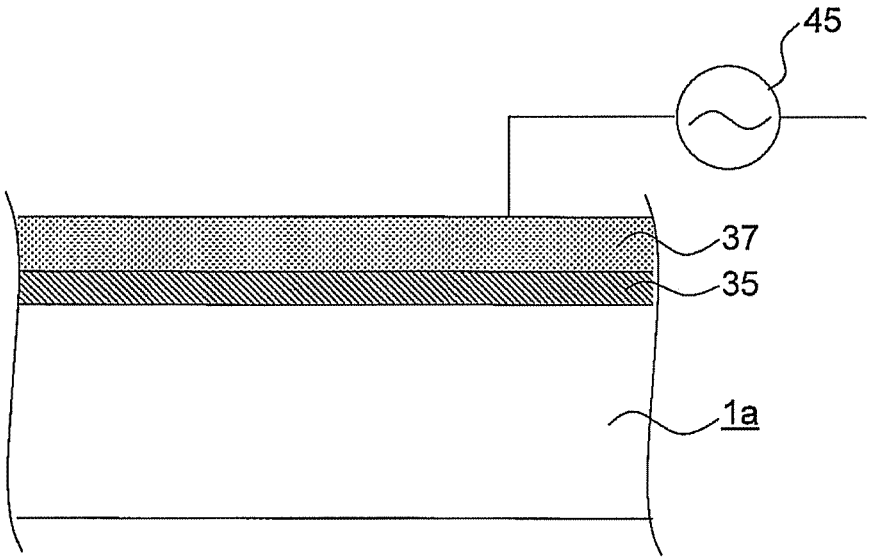
FIG. 18 is an enlarged sectional view showing a layered structure of the photosensitive drum 1*a* used in the color printer 100 of the sixth embodiment.

Next, a description is given of a color printer 100 according to a sixth embodiment of the present disclosure. FIG. 17 is a sectional side view of a vicinity of an end portion of a photosensitive drum 1*a* in the color printer 100 of the sixth embodiment, taken in a direction perpendicular to an axial direction of the photosensitive drum 1*a*, and FIG. 18 is an enlarged sectional view showing a layered structure of the photosensitive drum 1*a* used in the color printer 100 of the sixth embodiment. In this embodiment, as a conductive member used as a substitute for the conductive roller 30, a conductive layer 37 is layered on an inner peripheral surface of each of the photosensitive drums 1*a* to 1*d*. Further, a heating-up mode can be executed in which a bias including an alternating current (AC) bias is applied to the conductive layer 37 to cause a surface of each of the photosensitive drums 1*a* to 1*d* to be heated up. Other portions of the color printer 100 are configured similarly to those in the first to fifth embodiments, and descriptions thereof, therefore, are omitted. Furthermore, a principle based on which the surface of each of the photosensitive drums 1*a* to 1*d* heats up by application of an alternating current bias to the conductive layer 37 also is similar to the principle (see FIG. 6) in the cases of the first to fifth embodiments in which an alternating current bias is applied to the conductive roller 30.

As shown in FIGS. 17 and 18, an insulation layer 35 and the conductive layer 37 are layered on the inner peripheral surface of the photosensitive drum 1*a*. The insulation layer 35 is, for example, an alumite layer formed by subjecting an inner peripheral surface of a drum base member to alumite treatment. The insulation layer 35 can be formed also by, instead of forming an alumite layer, applying a coating of an insulative resin to the inner peripheral surface of the photosensitive drum 1*a* or attaching an insulative resin sheet thereto. As the insulative resin, a fluorine-based resin such as PTFE (polytetrafluoroethylene) or PFA (tetrafluoroethylene-perfluoroalkyl vinyl ether copolymer), a silicone resin, or the like is used. The insulation layer 35 preferably has a resistance value of not less than $10^{10}\Omega$.

On a surface of the insulation layer 35, the conductive layer 37 is layered. The conductive layer 37 is formed by applying a coating of a conductive material such as an EPDM rubber, a fluorine-based resin, nylon, or acrylic, having a resistance value of $10^{8}\Omega$ to $10^{8}\Omega$ or by attaching a sheet made of a conductive material. A heating-up bias power source 45 is connected to the conductive layer 37 so that a bias including an alternating current bias can be applied to the conductive layer 37.

In the color printer 100 of this embodiment, a bias is applied to the conductive layer 37 formed on the inner peripheral surface of each of the photosensitive drums 1*a* to 1*d*, and thus the photosensitive drums 1*a* to 1*d* can be heated up while any adverse effect on a photosensitive layer formed on the surface of each of the photosensitive drums 1*a* to 1*d* is suppressed. Furthermore, since a bias including an alternating current bias is applied to the conductive layer 37 formed on an entire region of the inner peripheral surface of each of the photosensitive drums 1*a* to 1*d*, compared with the first to fifth embodiments using the conductive roller 30, the entire surface (outer peripheral surface) of each of the photosensitive drums 1*a* to 1*d* can be heated up in a short time.

Moreover, in this embodiment, the insulation layer 35 is formed between the inner peripheral surface of each of the photosensitive drums 1*a* to 1*d* and the conductive layer 37. Thus, there occurs no electrical discharge between the inner peripheral surface of each of the photosensitive drums 1*a* to 1*d* and the conductive layer 37, so that the photosensitive drums 1*a* to 1*d* can be heated up without causing electrostatic destruction of the photosensitive layer on the surface of each of the photosensitive drums 1*a* to 1*d*. This also avoids the possibility that an image defect such as color spots or color streaks occurs.

As for a timing for executing the heating-up mode, preferably, the heating-up mode is executed at the time of non-image formation, for example, when the color printer 100 is started up from a power off state or a sleep (power saving) mode to a printing start state. In a case where the color printer 100 is in the power off state or the sleep mode, a vicinity of each of the photosensitive drums 1*a* to 1*d* is at a temperature decreased to room temperature, and this is a condition where image deletion is likely to occur due to condensation taking place on the photosensitive drums 1*a* to 1*d*. Hence, by executing the heating-up mode at the above-described timing, image deletion can be effectively suppressed.

Furthermore, in a condition where image deletion is particularly likely to occur, such as under a low-temperature and high-humidity environment, the heating-up mode may be continued also at the time of image formation. Since, as shown in FIGS. 17 and 18, the insulation layer 35 is formed on the inner peripheral surface of each of the photosensitive drums 1*a* to 1*d*, even when a bias is applied to the conductive layer 37 during image formation, there is no possibility that such bias application affects an electrostatic image or a toner image on the surface of each of the photosensitive drums 1*a* to 1*d*.

The conductive layer 37 is making contact not with the surface (outer peripheral surface) of each of the photosensitive drums 1*a* to 1*d* on which the photosensitive layer is formed but with the inner peripheral surface thereof on which the insulation layer 35 is formed. Thus, even when an alternating current bias is applied to the conductive layer 37 in a state where the photosensitive drums 1*a* to 1*d* are stopped from rotating, there occurs no image defect due to electrical discharge being concentrated at a portion of each of the photosensitive drums 1*a* to 1*d* where contact is made with the conductive layer 37. For this reason, similarly to the first to fifth embodiments, preferably, the heating-up mode is executed in the state where the photosensitive drums 1*a* to 1*d* are stopped from rotating.

As for a relationship between a factor of an alternating current bias to be applied to the conductive layer 37 and a heating-up effect on the photosensitive drums 1*a* to 1*d*, similarly to the first to fifth embodiments, at the time of executing the heating-up mode, it is necessary to apply to the conductive layer 37 an alternating current bias having a value of Vpp twice or more as large as a discharge start voltage Vth between the conductive layer 37 and each of the photosensitive drums 1*a* to 1*d*, and it is more preferable to apply thereto an alternating current bias having a frequency as high as possible.

Furthermore, an alternating current bias having such a high frequency that no electrical discharge occurs between the conductive layer 37 and each of the photosensitive drums 1*a* to 1*d* is applied to the conductive layer 37, and thus the photosensitive drums 1*a* to 1*d* can be heated up, with only oscillations of electrons and ions caused. As a result, while damage to the conductive layer 37 is suppressed to a minimum, the occurrence of image deletion can be effectively suppressed.

Furthermore, a direct current bias to be applied to the conductive layer 37 at the time of executing the heating-up mode is set to be as low as possible, so that degradation of the conductive layer 37 can be suppressed. To be specific, a direct current bias to be applied to the conductive layer 37 is set to be not higher than the discharge start voltage Vth, and thus a service life of the conductive layer 37 can be secured. Furthermore, when a direct current bias to be applied to the conductive layer 37 at the time of executing the heating-up mode is set to 0, degradation of the conductive layer 37 can be further suppressed.

In addition to the above, without being limited to the foregoing embodiments, the present disclosure can be variously modified within the spirit of the present disclosure. For example, while each of the foregoing embodiments describes an example in which, as each of the photosensitive drums 1*a* to 1*d*, an a-Si photosensitive drum is used, an exactly similar description can be made also in a case of using an organic photosensitive drum or a selenium arsenic photosensitive drum.

Furthermore, the present disclosure is not limited to the color printer 100 of an intermediate transfer type shown in FIG. 1 and is applicable to image forming apparatuses of various types such as a color copier and a printer of a direct transfer type, a monochrome copier, a digital multi-function peripheral, and a facsimile.

The present disclosure can be used, in an image forming apparatus using a photosensitive drum as an image bearing member, to remove moisture on a surface of the photosensitive drum. The use of the present disclosure can remove moisture on the surface of the photosensitive drum in a short time with high efficiency and thus can provide an image forming apparatus that is capable of effectively preventing the occurrence of image deletion over a long period of time.

What is claimed is:

1. An image forming apparatus, comprising:

an image bearing member that is cylindrical in shape and has a photosensitive layer formed on an outer peripheral surface thereof;

a conductive member that is disposed so as to make contact with an inner peripheral surface of the image bearing member and has a dielectric property;

a bias application device that applies a bias including an alternating current bias to the conductive member; and a control portion that controls the bias application device, wherein image formation is performed on a surface of the image bearing member while the image bearing member is made to rotate, and the image forming apparatus is capable of executing a heating-up mode in which an alternating current bias having a peak-to-peak value twice or more as large as a discharge start voltage between the conductive member and the image bearing member is applied to the conductive member to cause the surface of the image bearing member to be heated up.

2. The image forming apparatus according to claim 1, wherein an insulation layer is formed on at least one of a surface of the image bearing member where contact is made with the conductive member and a surface of the conductive member where contact is made with the image bearing member.

3. The image forming apparatus according to claim 2, wherein the image bearing member is made of aluminum, and the insulation layer is an alumite layer formed by subjecting the inner peripheral surface of the image bearing member to alumite treatment.

4. The image forming apparatus according to claim 2, wherein the insulation layer is an insulative resin layer formed on an outer peripheral surface of the conductive member.

5. The image forming apparatus according to claim 1, wherein a plurality of the conductive members make contact with the inner peripheral surface of the image bearing member.

6. The image forming apparatus according to claim 5, wherein the plurality of the conductive members make contact with the inner peripheral surface of the image bearing member at equal distances from one another.

7. The image forming apparatus according to claim 1, wherein the conductive member is a conductive roller obtained by forming a roller body made of a conductive material having a dielectric property on an outer peripheral surface of a metallic shaft.

8. The image forming apparatus according to claim 1, wherein the conductive member is a conductive layer formed on the inner peripheral surface of the image bearing member.

9. The image forming apparatus according to claim 8, wherein an insulation layer is formed between the inner peripheral surface of the image bearing member and the conductive layer.

10. The image forming apparatus according to claim 9, wherein the image bearing member is made of aluminum, and the insulation layer is an alumite layer formed by subjecting the inner peripheral surface of the image bearing member to alumite treatment.

11. The image forming apparatus according to claim 10, wherein the conductive layer is formed on a substantially entire region of the inner peripheral surface of the image bearing member.

12. The image forming apparatus according to claim 8, wherein the conductive layer is formed by layering a conductive resin on the inner peripheral surface of the image bearing member.

13. The image forming apparatus according to claim 1, wherein the heating-up mode is executed, at a time of non-image formation, in a state where the image bearing member is stopped from rotating.

14. The image forming apparatus according to claim 1, wherein a frequency of an alternating current bias to be applied to the conductive member at a time of executing the heating-up mode is set to a value not lower than a value thereof at which, when the frequency of the alternating current bias to be applied to the conductive member is made to vary so as to increase, electrical discharge no longer occurs between the image bearing member and the conductive member.

15. The image forming apparatus according to claim 1, wherein the bias application device is capable of applying to the conductive member a bias obtained by superimposing an alternating current bias on a direct current bias, and at a time of executing the heating-up mode, the bias application device applies to the conductive member a bias obtained by superimposing, on the alternating current bias, a direct current bias not higher than a discharge start voltage between the conducive member and the image bearing member.

16. The image forming apparatus according to claim 15, wherein a direct current bias to be applied to the conductive member at the time of executing the heating-up mode is set to 0.

17. The image forming apparatus according to claim 1, wherein the photosensitive layer formed on the outer peripheral surface of the image bearing member is an amorphous silicon photosensitive layer.

* * * * *